US011555338B2

(12) United States Patent
Nagaoka et al.

(10) Patent No.: US 11,555,338 B2
(45) Date of Patent: Jan. 17, 2023

(54) VEHICLE DOOR LATCH APPARATUS

(71) Applicant: MITSUI KINZOKU ACT CORPORATION, Yokohama (JP)

(72) Inventors: Tomoharu Nagaoka, Yokohama (JP); Hiroaki Fujiwara, Yokohama (JP)

(73) Assignee: MITSUI KINZOKU ACT CORPORATION, Yokohama (JP)

( * ) Notice: Subject to any disclaimer, the term of this patent is extended or adjusted under 35 U.S.C. 154(b) by 411 days.

(21) Appl. No.: 16/630,968

(22) PCT Filed: Oct. 20, 2017

(86) PCT No.: PCT/JP2017/038061

§ 371 (c)(1),
(2) Date: Jan. 14, 2020

(87) PCT Pub. No.: WO2019/016969

PCT Pub. Date: Jan. 24, 2019

(65) Prior Publication Data

US 2020/0224465 A1 Jul. 16, 2020

(30) Foreign Application Priority Data

Jul. 19, 2017 (JP) ..... JP2017-139726

(51) Int. Cl.
*E05B 81/34* (2014.01)
*E05B 79/20* (2014.01)
(Continued)

(52) U.S. Cl.
CPC ..... *E05B 81/34* (2013.01); *E05B 77/36* (2013.01); *E05B 79/04* (2013.01); *E05B 79/20* (2013.01); *E05B 81/20* (2013.01)

(58) Field of Classification Search
None
See application file for complete search history.

(56) References Cited

U.S. PATENT DOCUMENTS 4,575,138 A * 3/1986 Nakamura ..... E05B 79/20 292/216
5,584,207 A * 12/1996 Paul ..... B66D 3/20 74/505

(Continued)

FOREIGN PATENT DOCUMENTS

CN 105257122 A * 1/2016
CN 205189552 U * 4/2016

(Continued)

OTHER PUBLICATIONS

International Search Report dated Jan. 9, 2018, issued in counterpart International Application No. PCT/JP2017/038061 (2 pages).

*Primary Examiner* — Alyson M Merlino
(74) *Attorney, Agent, or Firm* — WHDA, LLP

(57) ABSTRACT

A power unit for a powered cinching mechanism with a favorable level of operational noise is provided. A door latch apparatus includes latch unit and power unit. Latch unit has latch that engages striker, ratchet that engages latch and first cinching lever that displaces latch from a half-latched position to a full-latched position. Latch unit is attached to an end portion of a vehicle door. Power unit includes motor, cable drum, deceleration mechanism and closed-type housing that houses them. Operational noise at 300 mm right above the housing of power unit is 42.2 to 40.9 dB at a supply voltage to the motor of 9V, 47.5 to 43.9 dB at a supply voltage of 12V, and 49.7 to 46.5 dB at a supply voltage of 16 V. Deceleration mechanism includes a worm gear and a helical gear.

5 Claims, 17 Drawing Sheets

(51) Int. Cl.

| | |
|---|---|
| ***E05B 81/20*** | (2014.01) |
| ***E05B 77/36*** | (2014.01) |
| ***E05B 79/04*** | (2014.01) |

(56) References Cited

U.S. PATENT DOCUMENTS

| | | | | |
|---|---|---|---|---|
| 9,938,760 | B2 * | 4/2018 | Makino | E05B 81/20 |
| 11,306,517 | B2 * | 4/2022 | Ilea | E05B 79/20 |

FOREIGN PATENT DOCUMENTS

| | | | | | |
|---|---|---|---|---|---|
| CN | 106761056 | A | * | 5/2017 | |
| CN | 106917552 | A | * | 7/2017 | E05B 79/20 |
| DE | 102013108718 | A1 | * | 2/2015 | E05B 77/36 |
| DE | 202014102930 | U1 | * | 11/2015 | E05B 81/20 |
| JP | 63-25768 | U | | 2/1988 | |
| JP | 1-230878 | A | | 9/1989 | |
| JP | 4-116567 | U | | 10/1992 | |
| JP | 2002-295095 | A | | 10/2002 | |
| JP | 2003-32973 | A | | 1/2003 | |
| JP | 2009-264052 | A | | 11/2009 | |
| JP | 2016-98628 | A | | 5/2016 | |
| JP | 2016-108797 | A | | 6/2016 | |
| KR | 100728445 | B1 | * | 3/2006 | |

* cited by examiner

VEHICLE DOOR LATCH APPARATUS

TECHNICAL FIELD

This application is based on and claims priority from Japanese Patent Application No. 2017-139726, filed on Jul. 19, 2017; the disclosure of which is hereby incorporated by reference herein in its entirety.

The present invention relates to a vehicle door latch apparatus, particularly to a vehicle door latch apparatus that includes a powered cinching mechanism that displaces a latch from a half-latched position to a full-latched position.

BACKGROUND ART

Conventionally, there is known a vehicle door latch apparatus that includes a power release mechanism that releases the restraint of a latch by means of motor power in order to make a door openable (Patent Literature 1). There is also known a vehicle door latch apparatus that includes a powered cinching mechanism (also referred to as a powered closing mechanism) that shifts a latch from a half-latched position to a full-latched position (Patent Literature 2).

Patent Literature 1: JP2002-295095A

Patent Literature 2: JP2016-98628A

SUMMARY OF INVENTION

Conventionally, the power source of a power release mechanism, which does not need high output power, is often provided integral with a latch unit having a latch and a ratchet. On the contrary, the power source of a powered cinching mechanism, which needs high output power, is often arranged near the center of a vehicle door, separate from the latch unit.

The latch unit is subject to many restrictions in design because it is fixed in a narrow and limited space of the rear end portion of a vehicle door that is furthest away from the rotation axis thereof. On the contrary, the power source of a powered cinching mechanism that is separately provided has much higher design flexibility. However, even a powered cinching mechanism of a luxury car generates a loud operation noise. The noise is reduced by a large amount of sound-proofing and sound-absorbing material that is used in the vehicle door.

A vehicle door latch apparatus of the present invention comprises:

a latch unit that is attached to an end portion of a vehicle door, the latch unit including:

- a latch that has a half-latching step that defines a half-latched position, as well as a full-latching step that defines a full-latched position, and that is rotated from an unlatched position toward the full-latched position when the latch engages a striker,
- a ratchet that prevents the latch from rotating in an unlatching direction when the ratchet engages the half-latching step and the full-latching step, and
- a first cinching lever that is rotated to displace the latch from the half-latched position to the full-latched position, a cable that rotates the first cinching lever; and a power unit that is attached to the vehicle door and that is separated from the latch unit, the power unit including a motor, a cable drum onto which one end of the cable is wound and that takes up and feeds the cable, a deceleration mechanism that transfers power of the motor to the cable drum, and a closed-type housing that houses the motor, the cable drum and the deceleration mechanism.

Operation noise at 300 mm right above the housing of the power unit is 42.2 to 40.9 dB at a supply voltage to the motor of 9V, 47.5 to 43.9 dB at a supply voltage of 12V, and 49.7 to 46.5 dB at a supply voltage of 16 V.

The deceleration mechanism includes a worm gear and a helical gear.

According to the present invention, the operation noise of a power unit can be reduced to a satisfactory level, and cost also can be saved.

The above and other objects, features and advantages of the present invention will become apparent from the following description with reference to the accompanying drawings which illustrate examples of the present invention.

List of Reference Numerals

| | | | |
|---|---|---|---|
| 10 | vehicle door latch apparatus | 11 | inside door panel |
| 12 | latch unit | 13 | operation unit |
| 14 | power unit | 15 | striker |
| 16 | latch | 16a | striker engaging groove |
| 16b | half-latching step | 16c | full-latching step |
| 16d | latch arm | 17 | ratchet |
| 17a | engaging end | 17b | ratchet pin |
| 18 | latch body | 18a | striker passage |
| 18b | guide groove | 19 | latch shaft |
| 20 | ratchet shaft | 21 | cover plate |
| 21a | cutaway passage | 22 | back plate |
| 23 | bracket | 23a | immobile lateral plane |
| 23b | immobile vertical plane | 24 | housing |
| 24a | main casing | 24b | side housing portion |
| 24c | casing cover | 25 | first cinching lever |
| 25a | one end | 25b | another end |
| 26 | connecting pin | 27 | second cinching lever |
| 27a | latch pushing end | 28 | follower pin |
| 29 | movable shaft | 30 | clutch lever |
| 30a | bearing surface | 31 | shaft |
| 32 | clutch spring | 33 | guide pin |
| 34 | cinching spring | 35 | emergency lever |
| 35a | bent portion | 35b | connecting arm |
| 36 | shaft | 37 | return lever |
| 38 | shaft | 39 | return spring |
| 40 | motor | 41 | worm gear |
| 42 | wheel gear | 42a | cam groove |
| 42a | wheel shaft | 43 | opening lever |
| 43a | cam arm | 44 | opening shaft |
| 45 | follower pin | 46 | opening spring |
| 47 | opening link | 47a | connecting hole |
| 48 | detection sensor | 49 | remote transmitter |
| 50 | door key cylinder | 51 | auxiliary opening lever |
| 52 | connecting rod | 52a | bottom end |
| 53 | inside opening handle | 54 | inner lever |
| 54a | abutting end | 55 | inner shaft |
| 56 | shaft | 57 | power lever |
| 58 | cable | 59 | abutting pin |
| 60 | service hole | 61 | attachment plate |
| 62 | sound-proofing and sound-absorbing cover | | |
| 63 | housing | 64 | main body |
| 64a | drive system housing chamber | 64b | back space |
| 64c | space | 65 | front cover |
| 66 | back cover | 67 | motor |
| 68 | cable drum | 68a | drum gear |
| 68b | cam protrusion | 69 | deceleration mechanism |
| 70 | two-stage gear | 70a | center shaft |
| 70b | large-diameter gear | 70c | small-diameter gear |
| 71 | support shaft | 72 | cylindrical worm |
| 73 | electric cable | 74 | drum sensor |
| 75 | connecting element | 76 | vibration damping rubber |
| 77 | brush arm | 78 | vibration damper |

DESCRIPTION OF EMBODIMENT

Figure 1:
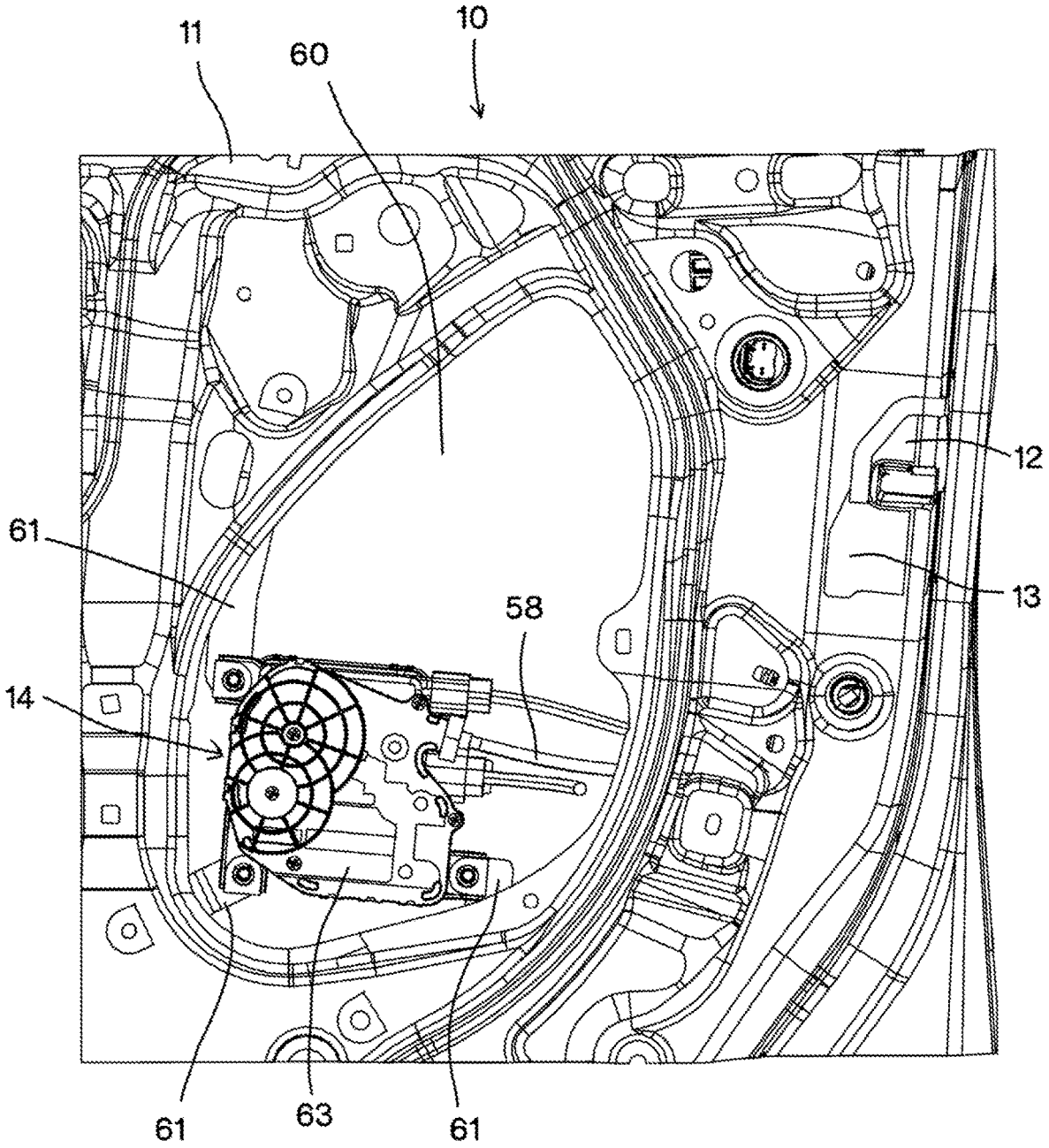
FIG. 1 is a side view of a vehicle door latch apparatus of the present invention that is attached to a vehicle inside door panel, as seen from the inside of the vehicle.

An embodiment of the present invention will be described with reference to the drawings. The present invention can be applied to a normal swing-type vehicle door, but the present invention can also be applied to a sliding-type vehicle door. FIG. 1 shows vehicle door latch apparatus 10 of the present invention, as well as metal inside door panel 11 of a vehicle door to which vehicle door latch apparatus 10 is attached. FIG. 1 illustrates the central and rear portions of inside door panel 11. The front portion is not illustrated.

Vehicle door latch apparatus 10 has latch unit 12, operation unit 13 and power unit 14. Latch unit 12 is fixed to the rear end of the vehicle door (inside door panel 11). Operation unit 13 is arranged on the back side of and adjacent to latch unit 12. Power unit 14 supplies door cinching power to operation unit 13. The door cinching power is used to fully latch the vehicle door. It should be noted that latch unit 12 and operation unit 13 are not strictly differentiated or separated and that these can also be grasped as latch assembly 12, as a whole.

Figure 3:
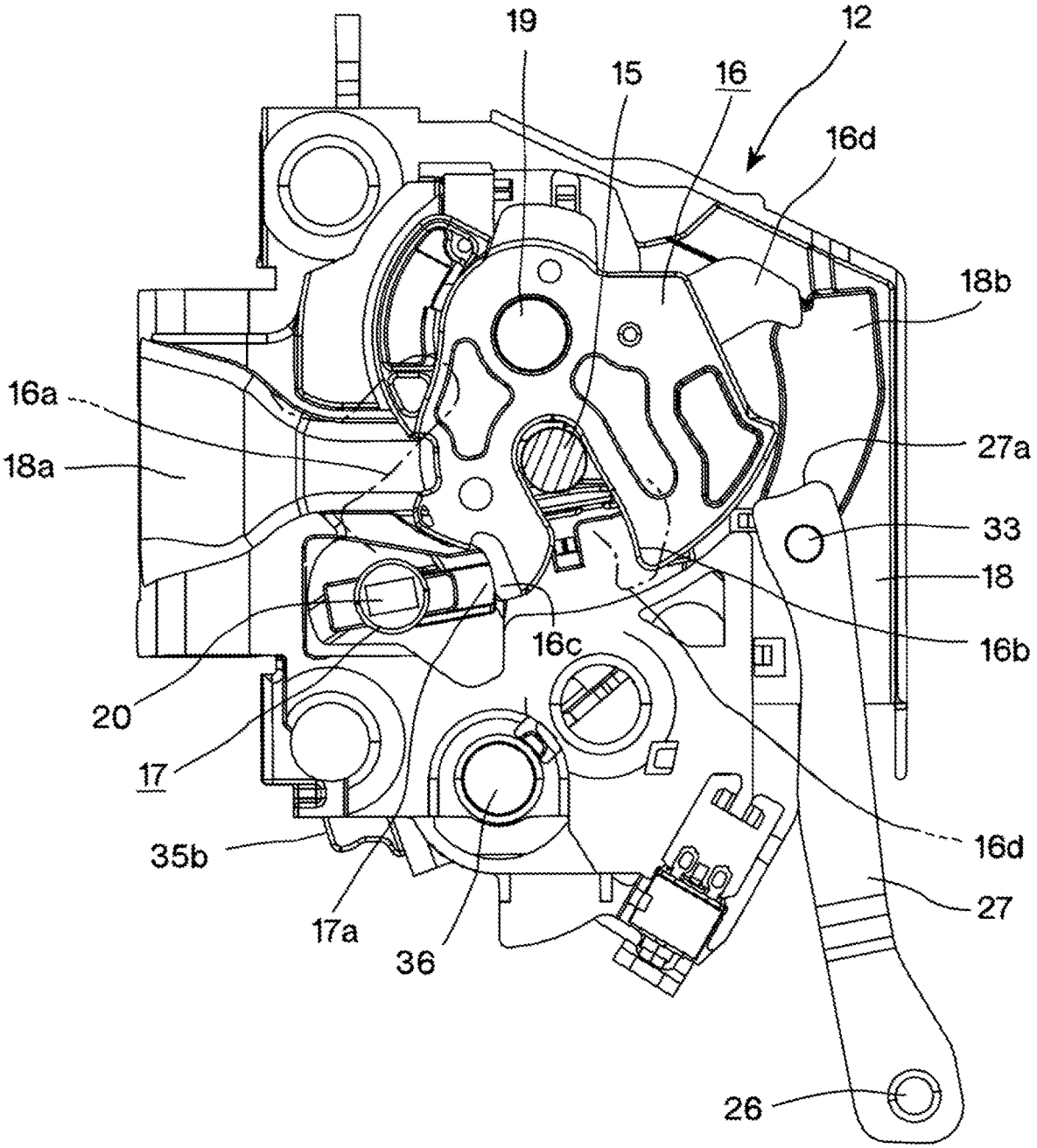
FIG. 3 is a front view of a latch unit of the vehicle door latch apparatus at the fully-latched position.

Latch unit 12 is arranged at the rear end of a vehicle door, which is the farthest part from the rotational shaft of the vehicle door, such that the front side illustrated in FIG. 3 is directed toward the rear part of the vehicle. Latch unit 12 has latch 16 that engages striker 15 of the vehicle, as well as ratchet 17 that keeps latch 16 engaged with striker 15. Latch 16 and ratchet 17 are housed in latch body 18 that is made of a synthetic resin and are rotated about latch shaft 19 and ratchet shaft 20, respectively.

When the vehicle door is moved in the door closing direction with a sufficiently large manual door closing force, striker 15 relatively goes into striker passage 18*a* that is formed in latch body 18 and then abuts against striker engaging groove 16*a* of latch 16 that is in the unlatched position, as depicted by the imaginary line in FIG. 3. Striker rotates latch 16 from the unlatched position in the fully-latching direction (in the anticlockwise direction) against the elastic force of a latch spring (not illustrated). When latch 16 comes to the half-latched position, engaging end 17*a* of ratchet 17 that is biased in the anticlockwise direction (the direction in which ratchet 17 engages latch 16) by the elastic force of a ratchet spring (not illustrated) is able to engage half-latching step 16*b* of latch 16 that defines the half-latched position. When latch 16 comes to the full-latched position, engaging end 17*a* is able to engage full-latching step 16*c* of latch 16 that defines the fully-latched position. When engaging end 17*a* of ratchet 17 engages full-latching step 16*c*, latch 16 is kept at the fully-latched position, and the door is kept closed.

Figure 2:
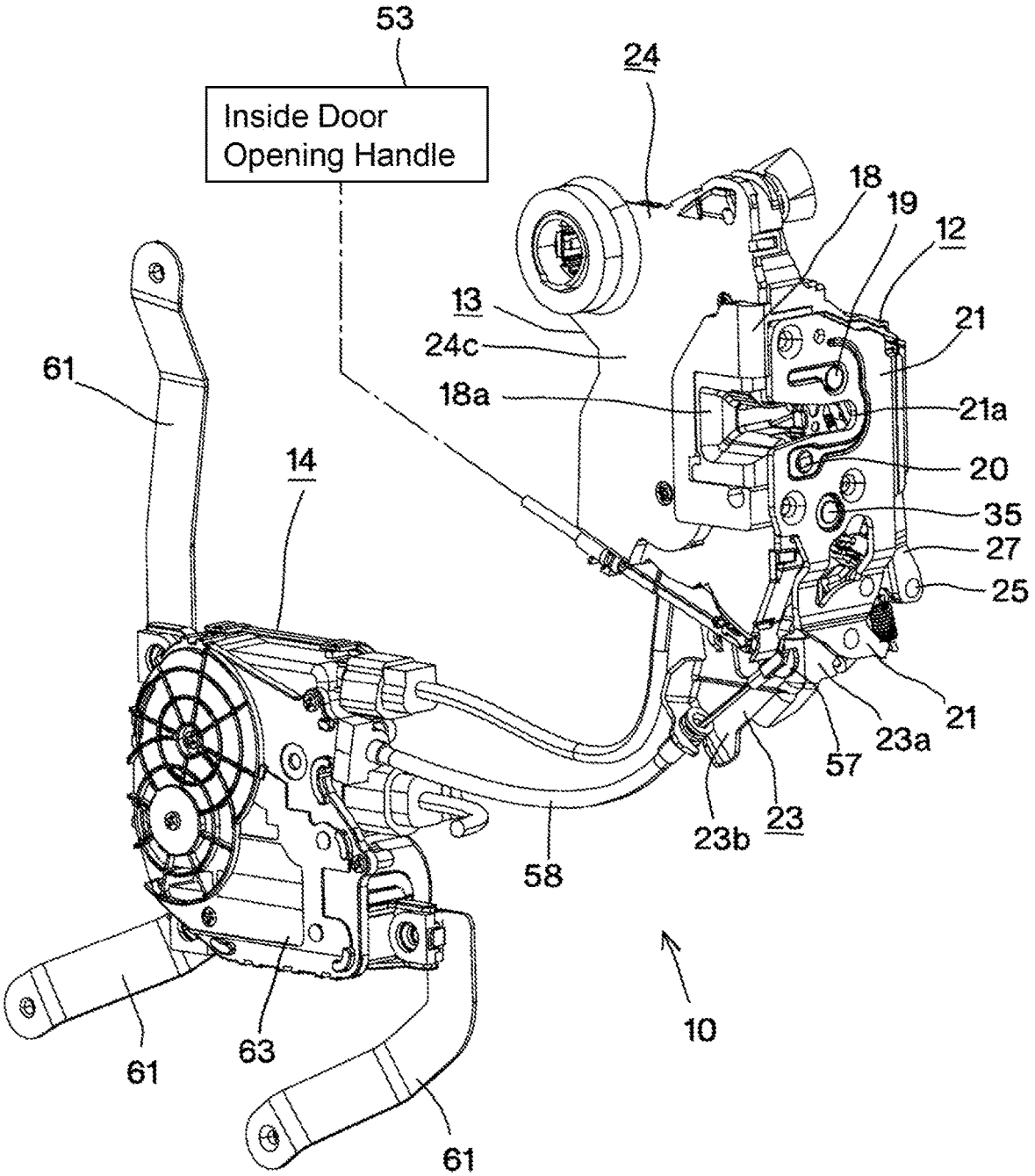
FIG. 2 is a general perspective view of the vehicle door latch apparatus.

As shown in FIG. 2, metal cover plate 21 is fixed to the front surface of latch body 18. Cutaway passage 21*a* that corresponds to striker passage 18*a* is formed in cover plate 21. In an ordinary swing-type vehicle door, latch shaft 19 and ratchet shaft 20 extend in the front-rear direction of the vehicle, and striker passage 18*a* and cutaway passage 21*a* are horizontally arranged.

Figure 4:
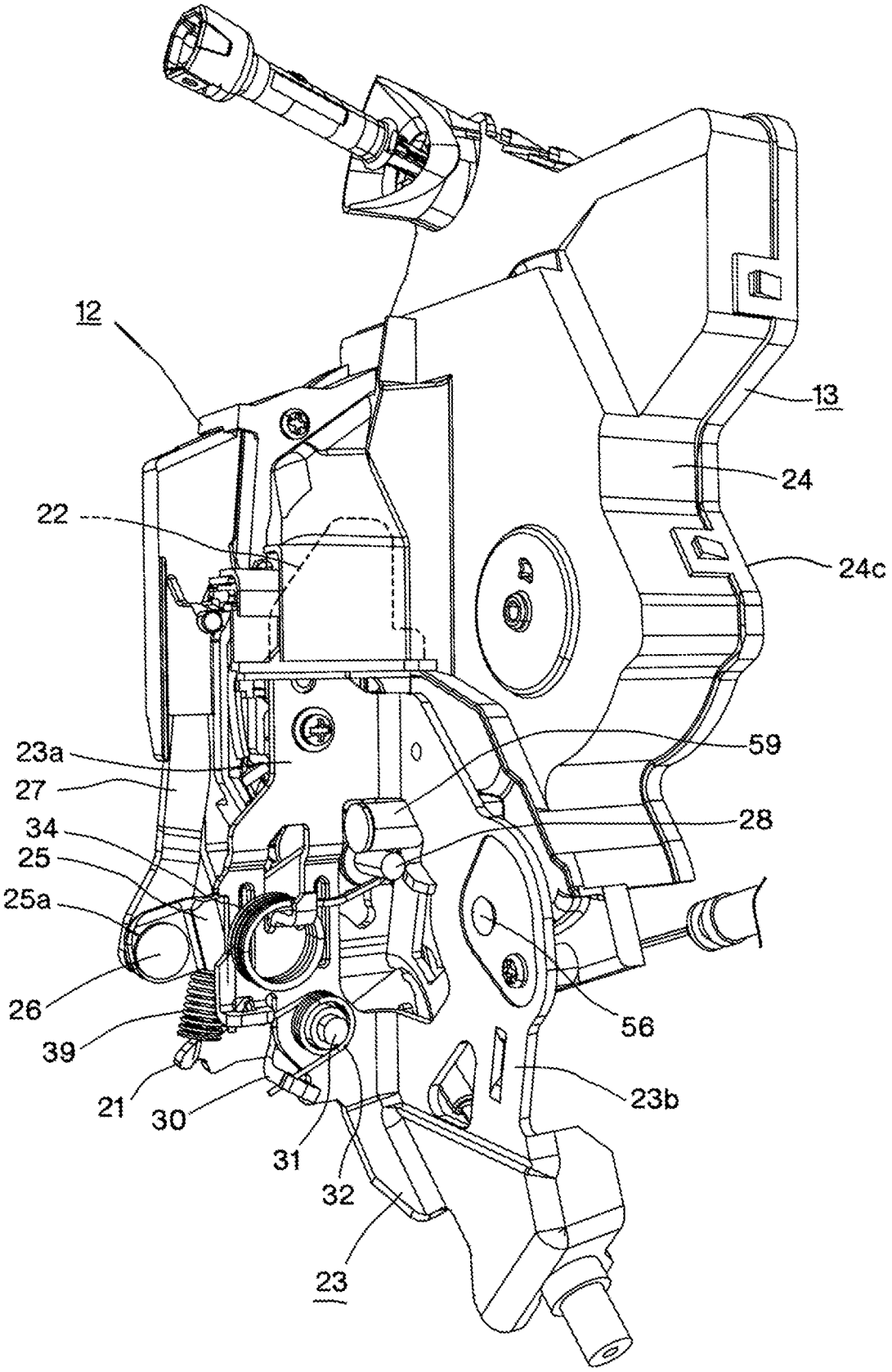
FIG. 4 is a rear perspective view of the latch unit and an operation unit of the vehicle door latch apparatus.

As shown in FIG. 4, upper metal back plate 22 and lower L-shaped metal bracket 23 (see FIGS. 10, 11) are fixed to the back surface of latch body 18. In FIG. 4, back plate 22 is generally covered with housing 24 of operation unit 13. Back plate 22 and bracket 23 may be formed in a single metal plate. Bracket 23 has immobile lateral plane 23*a* that is parallel to the door width direction, as well as immobile vertical plane 23*b* that is parallel to the door panel, and the lower part of housing 24 is fixed to immobile vertical plane 23*b*.

First cinching lever 25 (FIG. 11) that extends substantially horizontally is arranged between latch body 18 and immobile lateral plane 23*a* of bracket 23. The lower end of second cinching lever 27 is connected to one end 25*a* of first cinching lever 25 via connecting pin 26. Follower pin 28 is provided at another end 25*b* of first cinching lever 25. As described later, the driving force of power unit 14 is transmitted to follower pin 28 and pushes down and moves follower pin 28.

Figure 5:
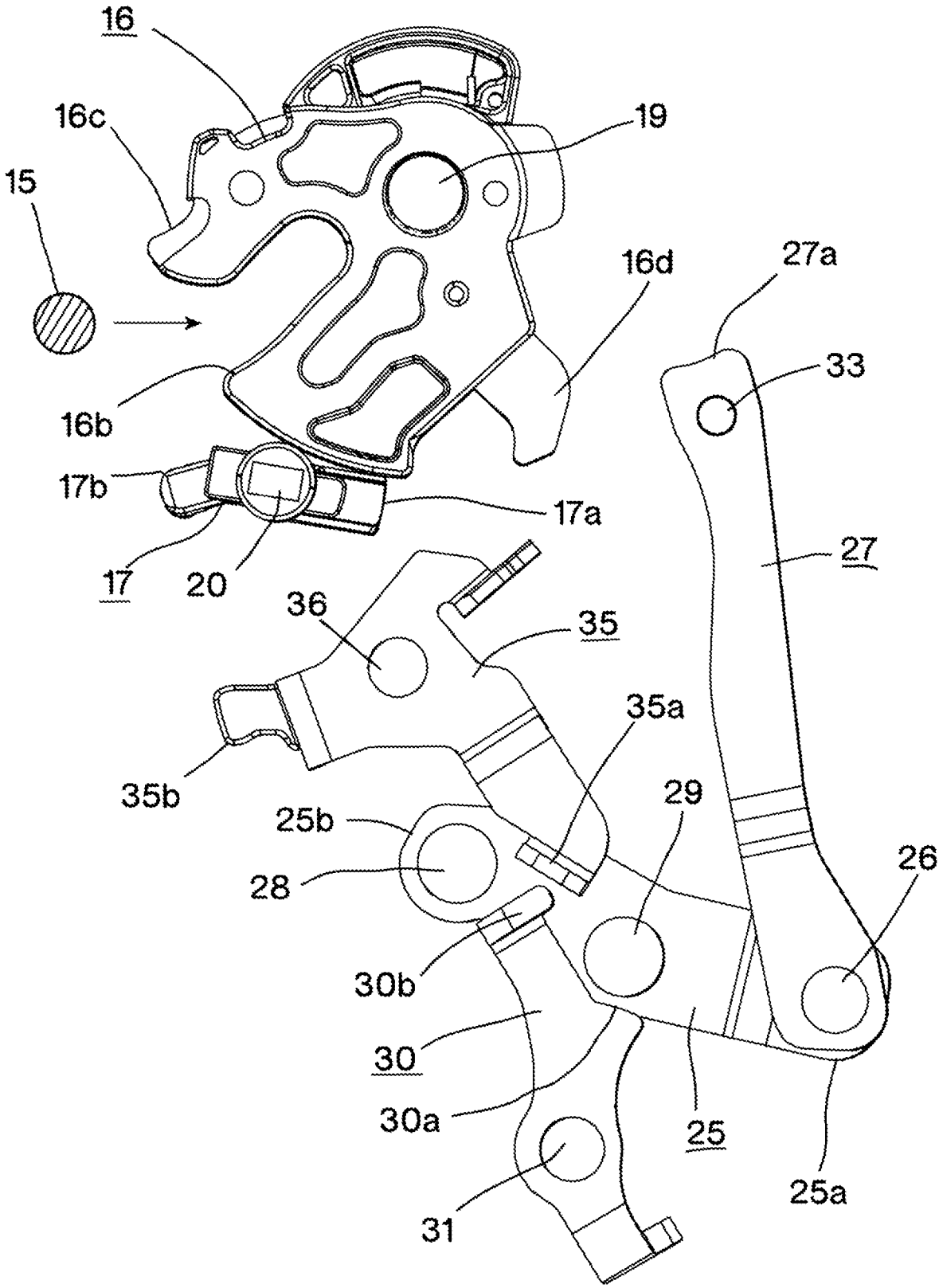
FIG. 5 is a partial front view of a powered cinching mechanism of the vehicle door latch apparatus at the waiting position.
Figure 12:
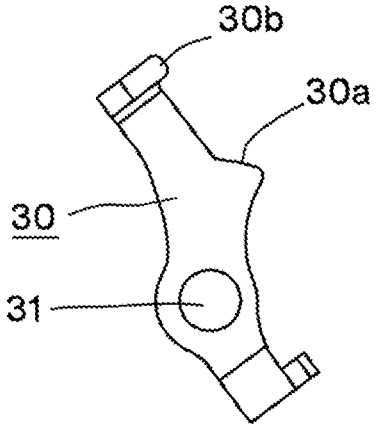
FIG. 12 is a front view of a clutch lever.

As shown in FIG. 5, movable shaft 29 is provided on first cinching lever 25 at the center thereof in the vehicle width direction. Movable shaft 29 is fixed to first cinching lever 25. Clutch lever 30 (FIG. 12) is arranged below first cinching lever 25 and is rotatably supported by immobile lateral plane 23*a* of bracket 23 or by an immobile element, such as cover plate 21, via shaft 31. Clutch lever 30 is biased in the clockwise direction in FIG. 5 by clutch spring 32 (FIG. 4).

Clutch lever 30 is provided with substantially horizontal bearing surface 30*a*, which supports movable shaft 29 of first cinching lever 25 from below. Movable shaft 29 is only placed on bearing surface 30*a* without being rotatably supported by any immobile element, such as latch body 18 or bracket 23. First cinching lever 25 functions based on the principle of leverage, in which follower pin 28 is the point of effort, connecting pin 26 is the point of load and movable shaft 29 (bearing surface 30*a*) is the fulcrum. When the driving force of power unit 14 pushes down follower pin 28, which is the point of effort, first cinching lever 25 is rotated about the "fulcrum" in the anticlockwise direction and raises second cinching lever 27.

Guide pin 33 is provided in the upper part of second cinching lever 27. Guide pin 33 slidably engages vertical guide groove 18*b* that is formed on the front surface of latch body 18. Latch pushing end 27*a* is provided at the top end of second cinching lever 27. Latch pushing end 27*a* can abut against latch arm 16*d* of latch 16 in the half-latched position by being raised, and thus can rotate latch 16 to the fully-latched position.

When the door is open, first cinching lever 25 is biased in the clockwise direction in FIG. 5 by the elastic force of cinching spring 34 (FIG. 4) and is kept at the waiting position, as shown in FIG. 5. At the waiting position shown in FIG. 5, latch arm 16*d* of latch 16 is located on the lateral side of latch pushing end 27*a* of second cinching lever 27, without facing latch pushing end 27*a*. In the state shown in FIG. 5, when the vehicle door is moved in the door closing direction with a manual door closing force and latch 16 is rotated to the half-latched position, latch arm 16*d* of latch 16 is positioned above or substantially above latch pushing end 27*a*. Further, at the half-latched position, power unit 14 is activated to rotate first cinching lever 25 in the anticlockwise direction and thereby to raise second cinching lever 27. Thus, latch pushing end 27 of second cinching lever 27 abuts against the lower surface of latch arm 16*d* of latch 16 in the half-latched position, rotates latch 16 to the fully-latched position, and thus the vehicle door is closed by the motor power. This is called the powered cinching mechanism.

As descried above, movable shaft 29 of first cinching lever 25 is only supported by bearing surface 30*a* of clutch lever 30 from below. This feature largely contributes to the disconnection of the power transmission path between power unit 14 and second cinching lever 27. Specifically, the power transmission path can be disconnected by depriving movable shaft 29 (bearing surface 30*a*), which is the fulcrum of lever, of the function of a "fulcrum". The power transmission path can be quite easily disconnected by rotating clutch lever 30 in the anticlockwise direction in FIG. 5 in order to remove the support for movable shaft 29. The friction force that is generated when bearing surface 30*a* is disconnected from movable shaft 29 is much smaller than the friction force that is generated when latch pushing end 27*a* is disconnected from latch arm 16*d* and is displaced to the lateral side thereof. Therefore, clutch lever 30 can be rotated in the disconnecting direction with a very small operational force.

Emergency lever 35 is rotatably supported by shaft 36 above another end 25*b* of first cinching lever 25 and on the back side of latch body 18. Bent portion 35*a* of emergency lever 35 is opposite to abutting part 30*b* of clutch lever 30. Emergency lever 35 is biased in the anticlockwise direction in FIG. 5 by a spring (not illustrated) and can rotate clutch lever 30 in the disconnecting direction (in the anticlockwise direction in FIG. 5) by being rotated in the clockwise direction against the elastic force of the spring.

Figure 6:
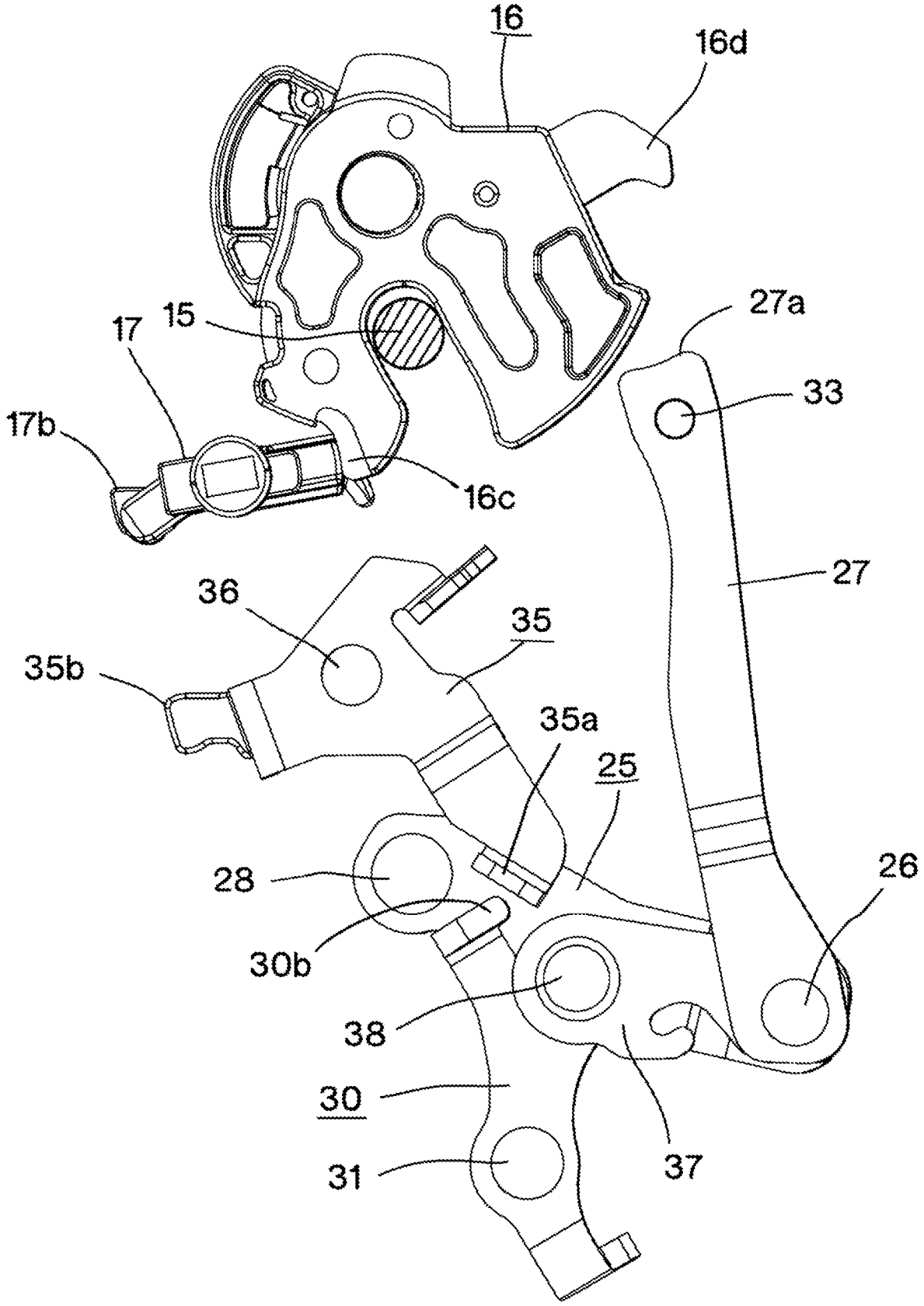
FIG. 6 is a front view of a part of the powered cinching mechanism, as well as a return lever of the vehicle door latch apparatus at the fully-latched position.

As shown in FIG. 6, lower connecting pin 26 of second cinching lever 27 is also connected to the pivoting end of return lever 37. The base of return lever 37 is rotatably supported by cover plate 21 via shaft 38. Shaft 38 is separated from movable shaft 29. The axis of movable shaft 29 preferably matches the axis of shaft 38 in the vehicle front-rear direction when first cinching lever 25 is at the waiting position, but the former does not need to completely match the latter. Return lever 37 is biased in the clockwise direction in FIG. 6 by return spring 39 (FIG. 4). When movable shaft 29 of first cinching lever 25 no longer functions as a "fulcrum", return lever 37 quickly lowers second cinching lever 27 in the raised position to the lower waiting position by the elastic force of return spring 39 in order to instantaneously allow latch 16 to rotate in the releasing direction.

Clutch lever 30 is rotated in the clockwise direction by the elastic force of clutch spring 32 when clutch lever 3 is disconnected from emergency lever 35. Bearing surface 30*a* moves beneath movable shaft 29 of first cinching lever 25 that has lost the function of a "fulcrum", and returns to the waiting position shown in FIG. 5. At the waiting position shown in FIG. 5, bearing surface 30*a* of clutch lever 30 is preferably opposite to movable shaft 29 with a slight gap therebetween. This enables smooth return of clutch lever 30 by the elastic force of clutch spring 32. When first cinching lever 25 is rotated in the anticlockwise direction by power unit 14, movable shaft 29 of first cinching lever 25 is lowered a distance equal to the gap and then obtains the function of the "fulcrum" when it abuts against bearing surface 30*a*.

Figure 7:
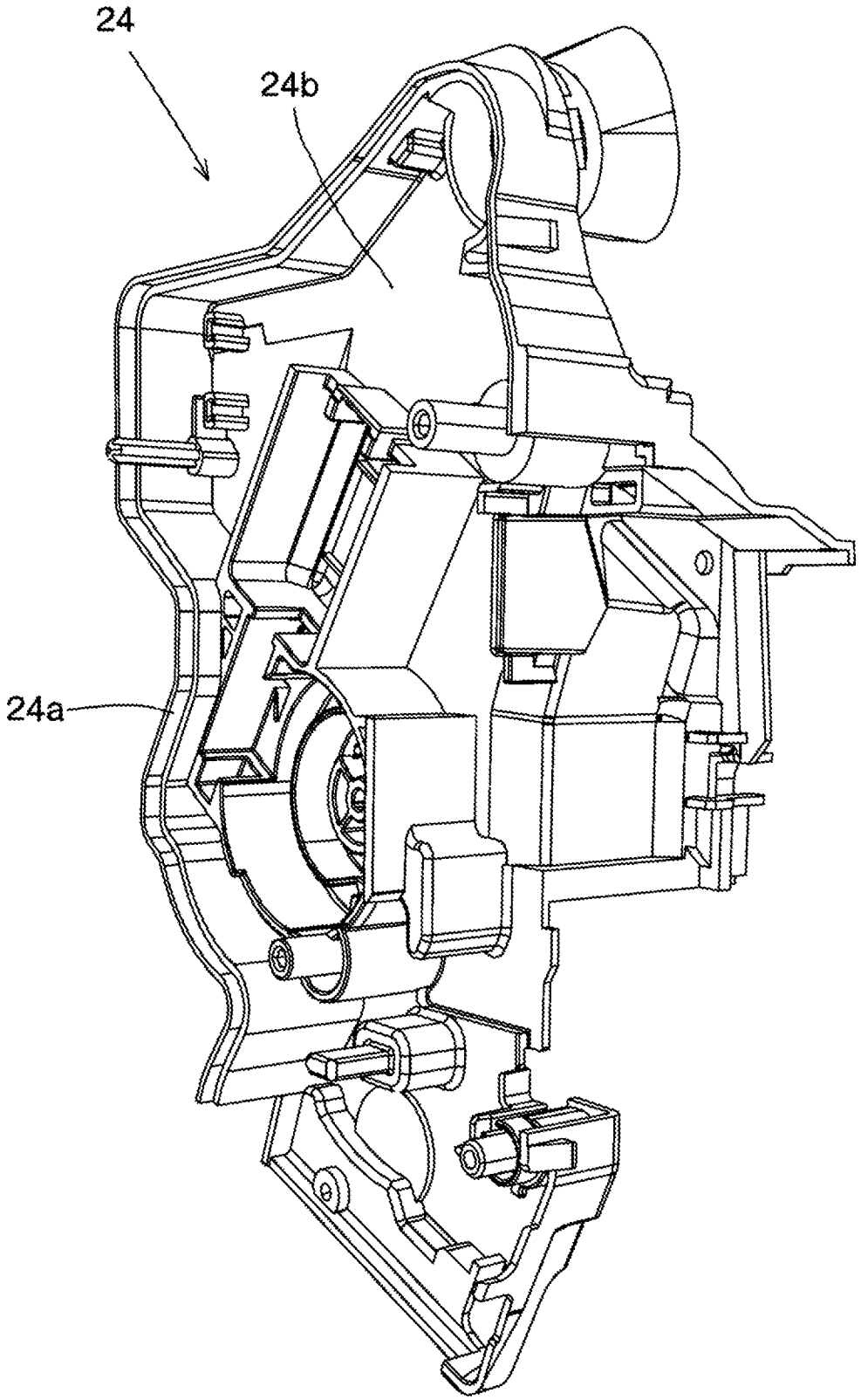
FIG. 7 is a front perspective view of a main casing of a housing of the operation unit.

As shown in FIG. 7, housing 24 of operation unit 13 includes L-shaped main casing 24*a*, as well as casing cover 24*c* (FIG. 2) that covers side housing portion 24*b* of main casing 24*a*. Side housing portion 24*b* extends in parallel with immobile vertical plane 23*b* of bracket 23, houses main elements shown in FIG. 8 and is covered with casing cover 24*c*.

Side housing portion 24*b* houses door-opening motor 40 that is much smaller than power unit 14. Cylindrical worm gear 41 of motor 40 engages worm wheel gear 42. Worm wheel gear 42 is rotatably supported by main casing 24*a* via wheel shaft 42*b* that extends in the door width direction, and cam groove 42*a* is formed on the wheel surface thereof.

In the vicinity of worm wheel gear 42, door opening lever 43 is rotatably supported by main casing 24*a* via opening shaft 44. Follower pin 45 is formed on cam arm 43*a* of opening lever 43 that extends leftward in FIG. 8, and is slidably engaged with cam groove 42*a*.

Figure 8:
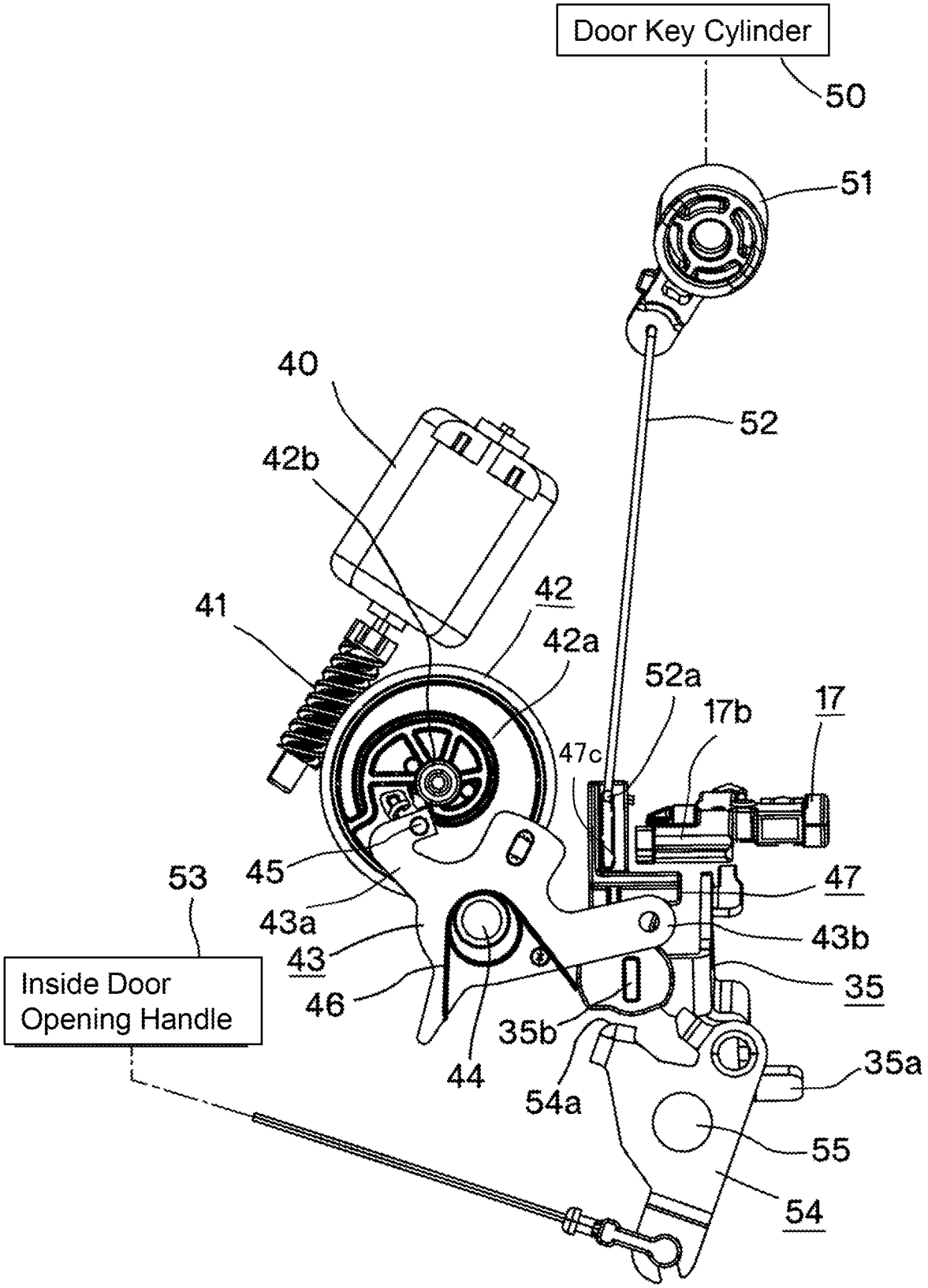
FIG. 8 is a side view of various elements that are housed in a side housing portion of the main casing.

Worm wheel gear 42 is usually kept at the position illustrated in FIG. 8 by the elastic force of a return spring, not illustrated. When worm wheel gear 42 is rotated in the clockwise direction by the power of motor 40, opening lever 43 is pushed out by cam groove 42*a* and is rotated in the anticlockwise direction against the elastic force of opening spring 46.

Figure 13:
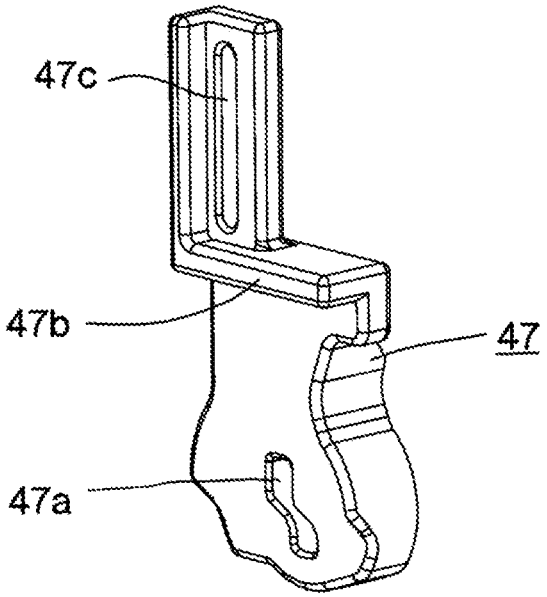
FIG. 13 is an enlarged perspective view of an opening link.
Figure 14:
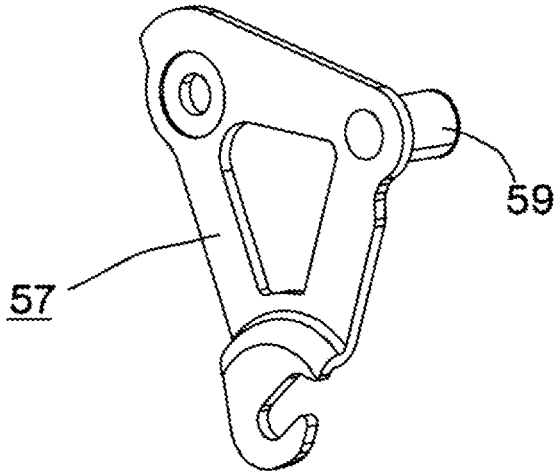
FIG. 14 is an enlarged perspective view of a power lever.
Figure 15:
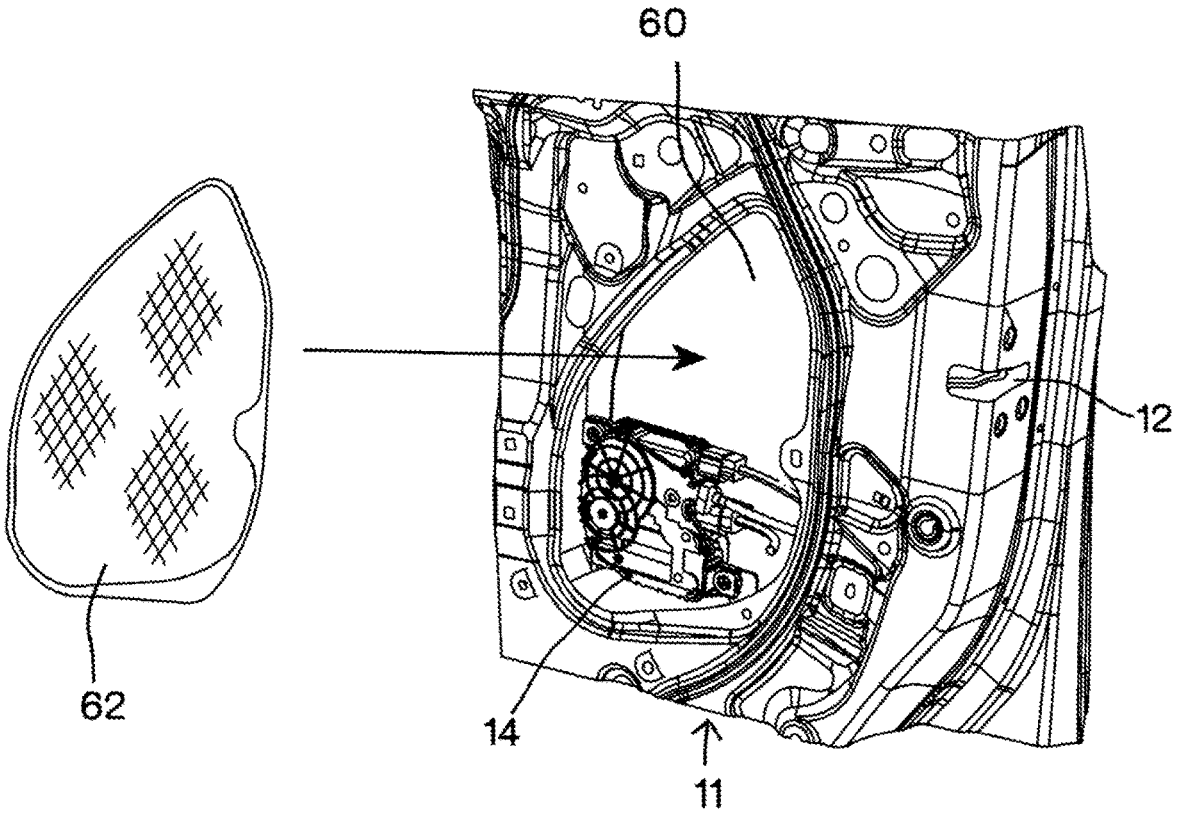
FIG. 15 is an exploded perspective view of the inside door panel and the sound-proofing and sound-absorbing cover.
Figure 16:
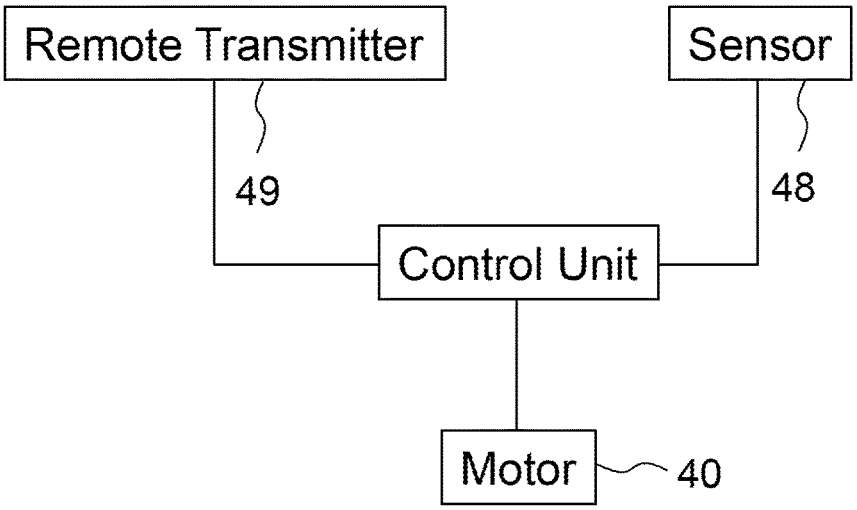
FIG. 16 is a block diagram of control.

Vertical opening link 47 (FIG. 13) is arranged at a location where it overlaps abutting arm 43*b* of opening lever 43 that extends rightward in FIG. 8. Connecting hole 47*a* is provided in the lower part of opening link 47, and tip end of connecting arm 35*b* of emergency lever 35 (FIG. 5) is inserted through and connected to connecting hole 47*a*. When opening link 47 is raised, emergency lever 35 is rotated in the clockwise direction in FIG. 5.

Bent abutting part 47*b* is provided at or near the center of opening link 47 in the vertical direction. The lower surface of bent abutting part 47*b* is opposite to the end of abutting arm 43*b* of opening lever 43 that extends rightward in FIG. 8. When opening lever 43 is rotated in the anticlockwise direction in FIG. 8 by the driving force of motor 40, opening link 47 is raised.

The upper surface of bent abutting part 47*b* of opening link 47 is opposite to ratchet pin 17*b* that is positioned at the end of ratchet 17. When opening link 47 is raised, ratchet 17 is rotated in the clockwise direction in FIG. 3 against the elastic force of a ratchet spring (not illustrated), and is disengaged from latchet 16 so that the door is placed in the openable state.

Since motor 40 that disengages ratchet 17 from latch 16 by motor power is housed in side housing portion 24*b* of housing 24 that is covered with casing cover 24*c*, the operation noise is shielded and sound pressure is limited within an appropriate range. Furthermore, the driving force of motor 40 is transmitted through both cam groove 42*a* that is formed on wheel gear 42 and follower pin 45 that is formed on opening lever 43. This achieves proper sound pressure and sound quality.

In principal, opening lever 43 (opening link 47) of the present invention is rotated in the opening direction (moved in the opening direction) by the driving force of motor 40. Motor 40 is activated by a detection signal from detection sensor 48 that is provided on a door grip of a vehicle door or the like or by an opening signal from remote transmitter 49 that is held by a driver. Accordingly, in vehicle door latch apparatus 10 of the present invention, a so-called "locking mechanism" that shifts between the locked state and the unlocked state and that is essential in the conventional vehicle door latch apparatus is omitted, and the structure is significantly simplified. In other words, disconnecting means to disconnect the power transmission path, such as "locking mechanism", can be omitted because motor 40 can only be activated by a specific person.

In order to cope with malfunction of motor 40 or of the power transmission path, two safety measures are adopted. The first measure is achieved by door key cylinder 50. Door key cylinder 50 is provided on the outside metal door panel (not illustrated) of the vehicle door. A conventional door key cylinder is connected to a "locking mechanism", which is not provided in the present invention, and the locking mechanism is used for shift between the locked state and the unlocked state. On the other hand, in the present invention, door key cylinder 50 is connected to auxiliary opening lever 51 that is provided in side housing portion 24*b* of housing 24. Auxiliary opening lever 51 is connected to the upper end of connecting rod 52, and bottom end 52*e* of connecting rod 52 is connected to vertical slot 47*c* of opening link 47 with play in the vertical direction.

Due to this arrangement, it is possible to raise opening link 47 via connecting rod 52, to disengage ratchet 17 from latch 16 and thereby to place the door in the openable state even under an unexpected circumstance by rotating door key cylinder 50 by means of a proper key plate.

The second measure is achieved by providing inside door opening handle 53 on the inner side of a vehicle door and by connecting inner lever 54 that is provided in side housing portion 24*b* of housing 24 to inside opening handle 53. Inner lever 54 is rotated in the clockwise direction about inner shaft 55 in FIG. 8 by the door opening operation of inside opening handle 53. When abutting end 54*a* of inner lever 54 abuts against the lower end of opening link 47, opening link 47 is raised to disengage ratchet 17 from latch 16 and thereby to place the door in the openable state.

In the arrangement described above, there is also an advantageous feature in the structure in which the bottom part of opening link 47 is supported by connecting arm 35*b* of emergency lever 35. In daily operation, opening link 47 that is raised only by the power of motor 40 activates clutch lever 30 via emergency lever 35 and inactivates the "fulcrum" of first cinching lever 25 each time opening link 47 is raised. Accordingly, even when second cinching lever 27 is raised to and stopped at the fully-latched position due to a malfunction of power unit 14, second cinching lever 27 quickly returns to the lower waiting position by the elastic force of return spring 39 and allows latch 16 to rotate in the releasing direction without any interference from second cinching lever 27 because when motor 40 is activated by an operation signal, the "fulcrum" of first cinching lever 25 is simultaneously inactivated.

In addition, the arrangement in which opening link 47 is supported by emergency lever 35 simplifies the structure and enables rational design.

Figure 9:
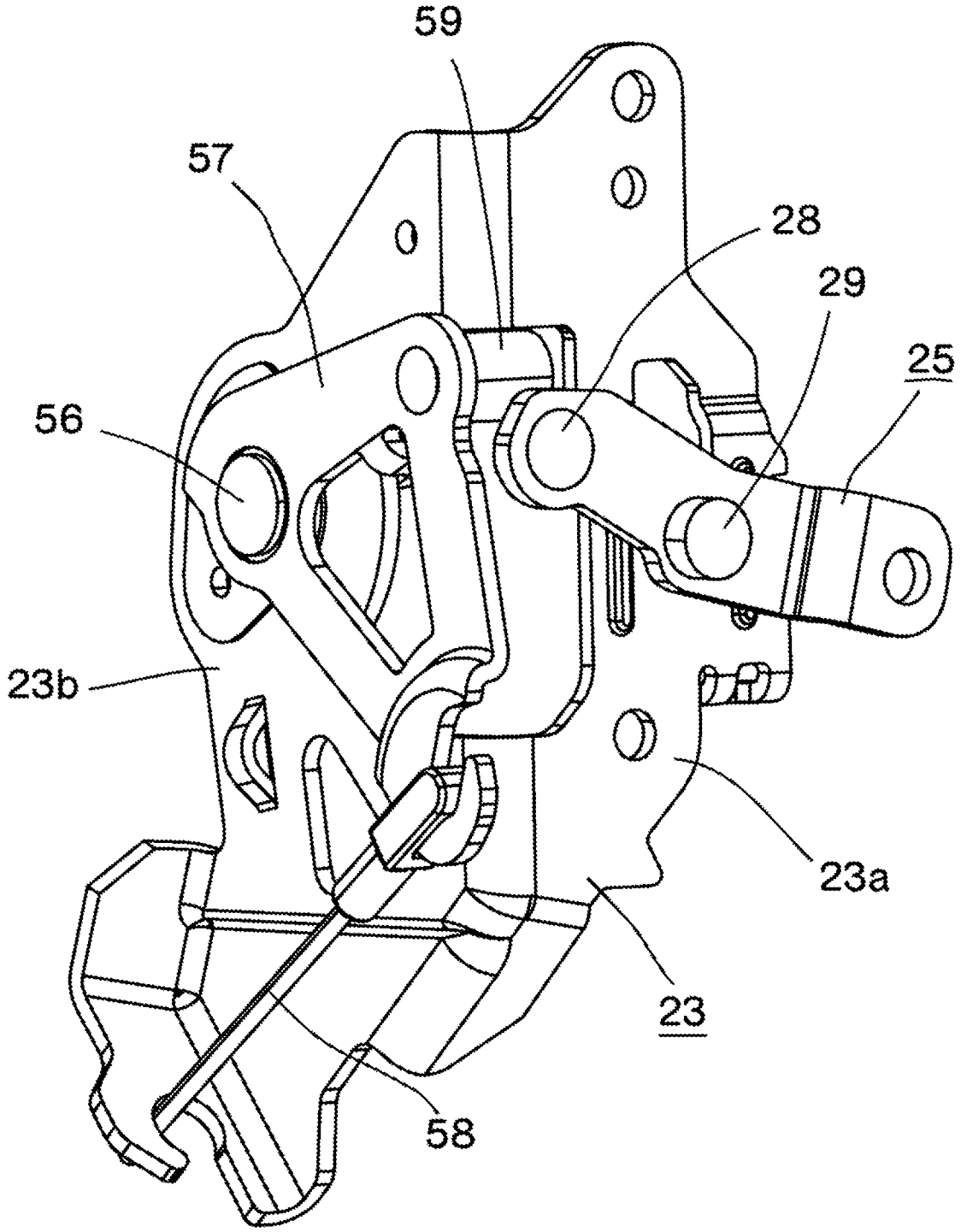
FIG. 9 is a front perspective view of a L-shaped bracket, a power lever and a cinching lever.
Figure 10:
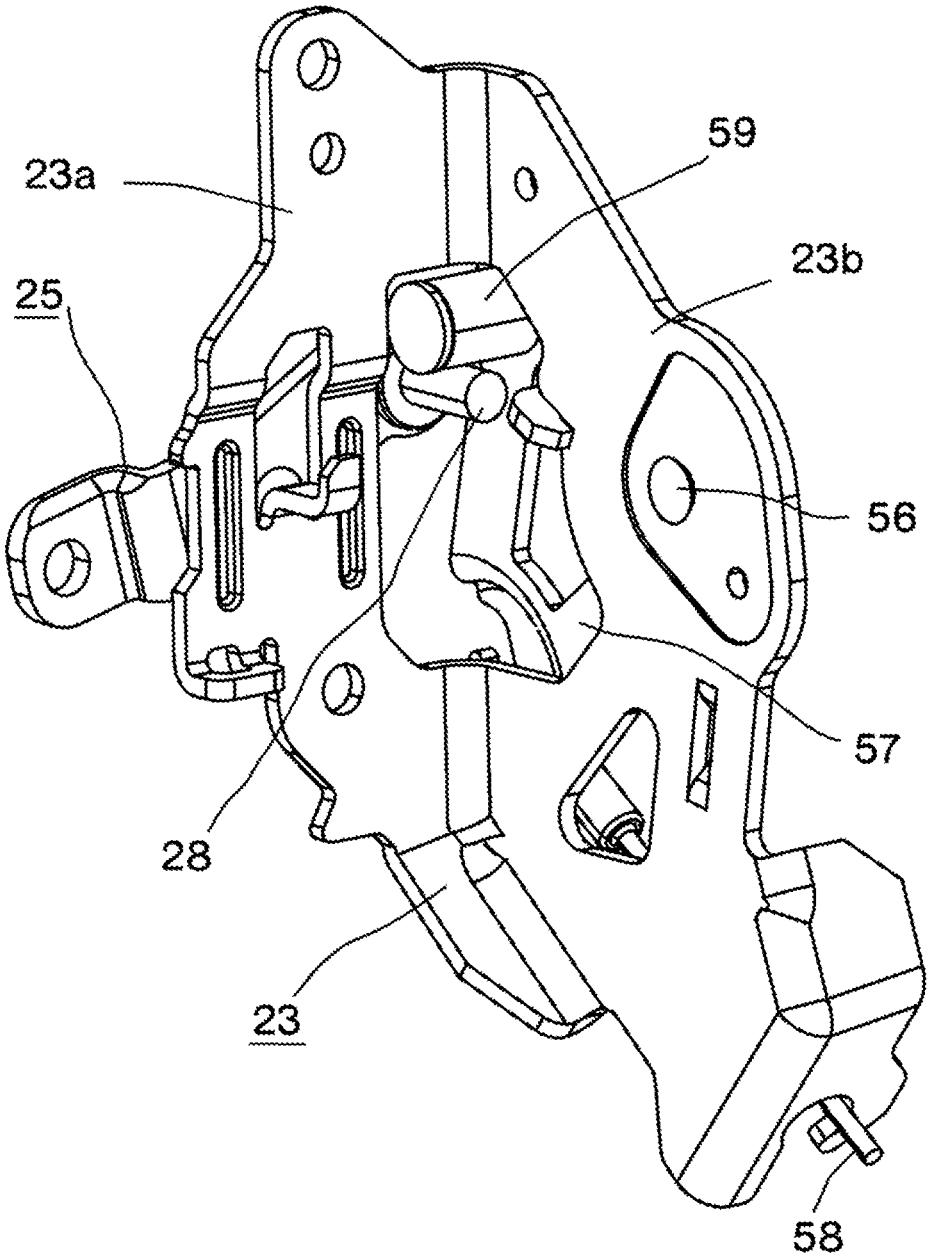
FIG. 10 is a rear perspective view of the L-shaped bracket, the power lever and the cinching lever.
Figure 11:
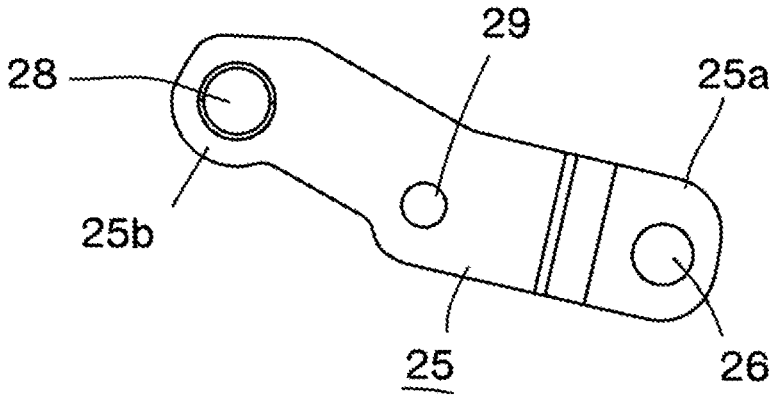
FIG. 11 is a front view of the cinching lever.

As shown in FIGS. 9, 10, power lever 57 is rotatably supported by the lower part of immobile vertical plane 23*b* of bracket 23 via shaft 56 that extends in the door width direction. Power lever 57 is connected to power unit 14 via cable 58. Power lever 57 is provided with abutting pin 59 that extends in the door width direction, and abutting pin 59 engageably faces follower pin 28 of first cinching lever 25.

When power lever 57 is rotated by the power of power unit 14, abutting pin 59 pushes down follower pin 28, rotates first cinching lever 25 in the anticlockwise direction in FIG. 5 and raises second cinching lever 27. Thus, latch 16 is rotated from the half-latched position to the fully-latched position and closes the door.

As shown in FIG. 1, power unit 14 is arranged such that it overlaps service hole 60 of inside door panel 11, as seen in the door width direction, and is fixed to inside door panel 11 by means of attachment plates 61. After power unit 14 is fixed to inside door panel 11, service hole 60 is covered with sound-proofing and sound-absorbing cover 62.

Power unit 14 is a sound-proofing and vibration-proofing power unit. Due to the synergy with sound-proofing and sound-absorbing cover 62, excellent sound pressure and sound quality can be obtained, as compared to an arrangement in which power unit 14 is arranged on the back side of a metal surface of inside door panel 11 such that it overlaps the metal surface of inside door panel 11, as seen in the door width direction.

Figure 18:
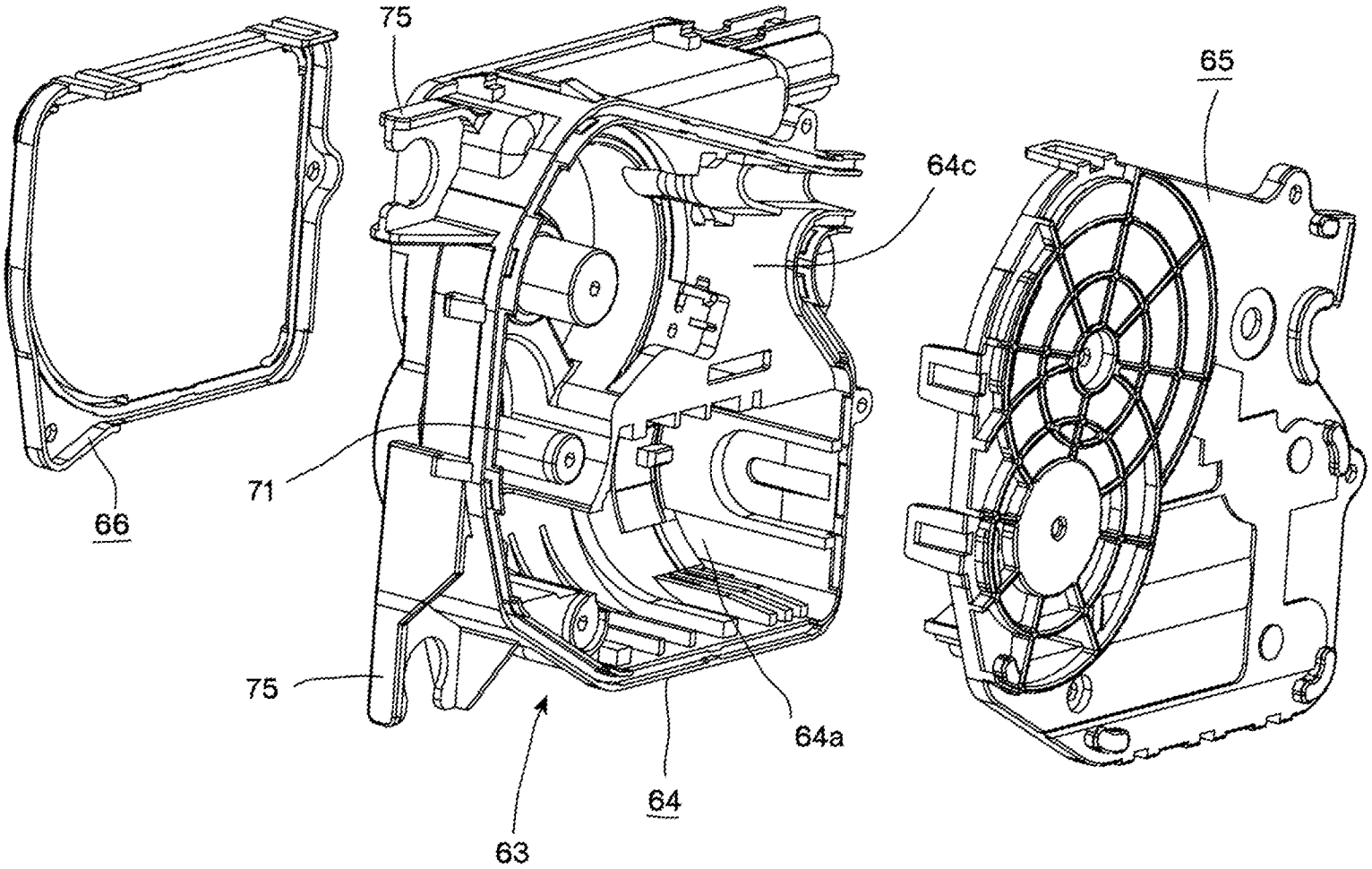
FIG. 18 is an exploded perspective view of a housing of the power unit.
Figure 19:
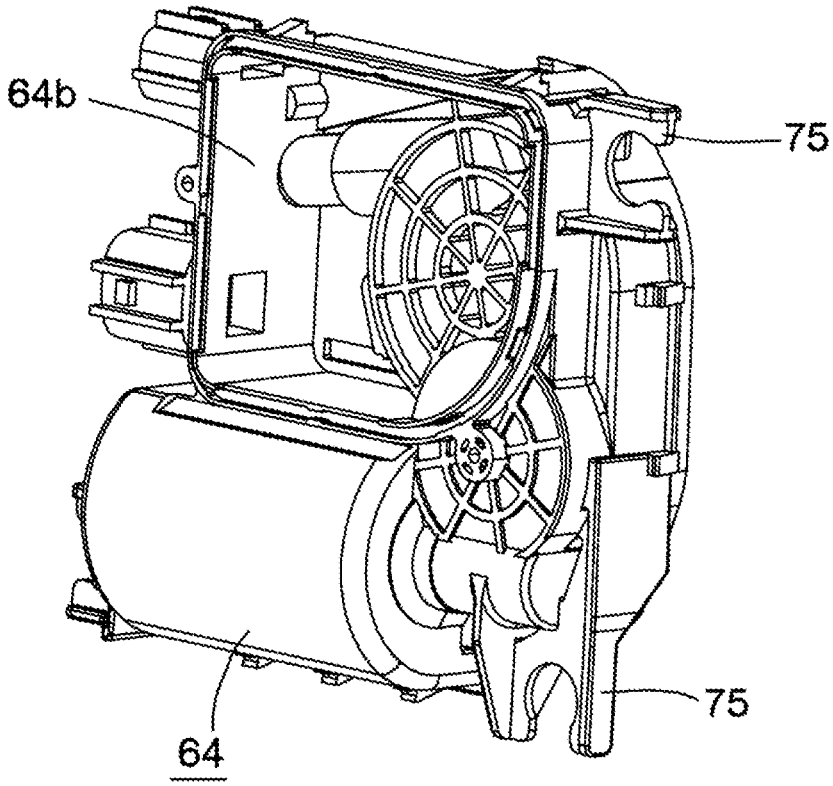
FIG. 19 is a perspective view of a main body of the housing of the power unit, as seen from the outside of the vehicle.
Figure 20:
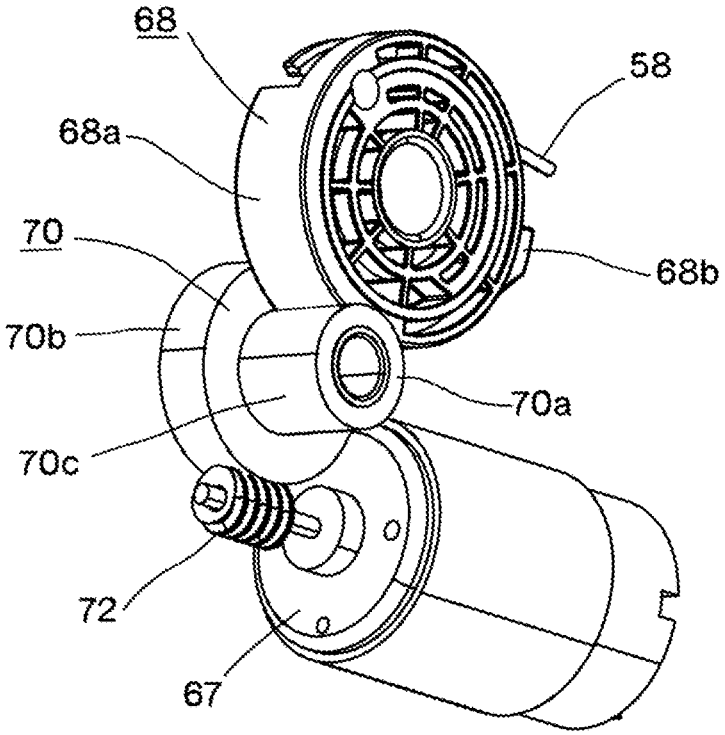
FIG. 20 is a perspective view of a drive unit of the power unit, as seen from the outside of the vehicle.

As is well illustrated in FIG. 18, housing 63 of power unit 14 includes main body 64 that is formed of resin, front cover 65 that is formed of resin and that covers drive system housing chamber 64*a* that is formed on the inner side of main body 64, and back cover 66 that covers rear space 64*b* (FIG. 19) that is formed on the outer side of main body 64. Front cover 65 and back cover 66 are fixed to main body 64 via waterproof sealing members (not illustrated) in a watertight manner.

Drive system housing chamber 64*a* of main body 64 houses motor 67 that serves as a power source, cable drum 68 that takes up and feeds cable 58 and deceleration mechanism 69 that transfers the power of motor 67 to cable drum 68. By taking up cable 58 onto cable drum 68, power lever 57 of operation unit 13 is rotated and first cinching lever 25 is activated.

Figure 17:
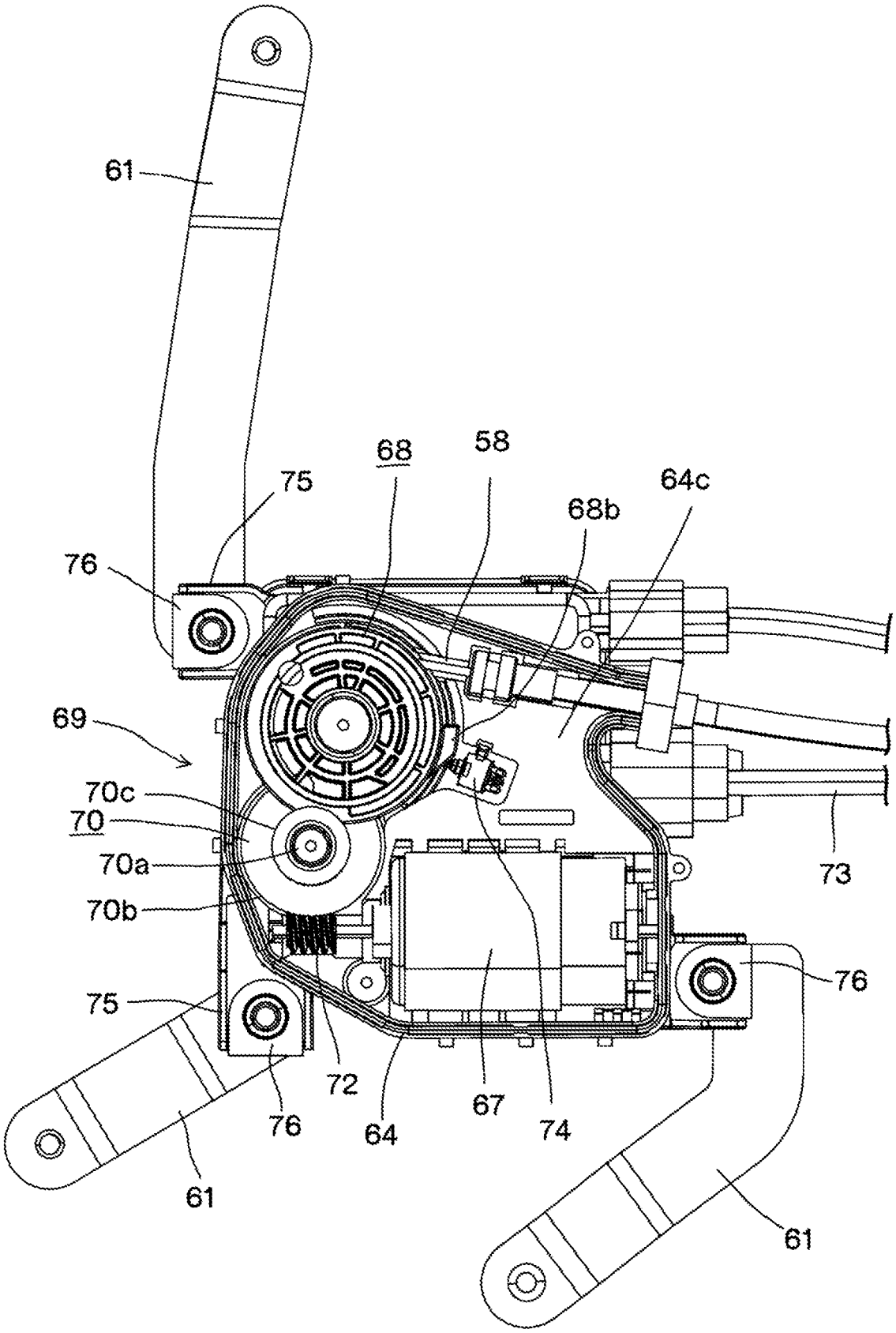
FIG. 17 is a side view of a power unit with a drive system cover removed, as seen from the inside of the vehicle.

As shown in FIG. 17, motor 67 is arranged in the lower portion of drive system housing chamber 64*a* such that the output shaft of motor 67 extends in the horizontal direction. Deceleration mechanism 69 and cable drum 68 are arranged adjacent to each other in the vertical direction on one side of drive system housing chamber 64*a*. Motor 67, deceleration mechanism 69 and cable drum 68 are arranged in an L shape, as a single unit. As a result, space 64*c* without any movable member is created in the upper portion of the other side of drive system housing chamber 64*a*. By using space 64*c*, rear space 64*b* is created on the back side (inner side) of main body 64.

Two-stage gear 70, which is a main element of deceleration mechanism 69, is integrally molded from a resin. Support shaft 71 that is formed in main body 64 is inserted through hollow center shaft 70*a* so that center shaft 70*a* is rotatably supported by main body 64. Large-diameter gear 70*b* of two-stage gear 70 is a worm wheel gear that engages cylindrical worm 72 that is attached to the output shaft of motor 67. Small-diameter gear 70*c* that is coaxial with large-diameter gear 70*b* is a helical gear (a cylindrical gear having helix-shaped teeth). Drum gear 68*a* in the shape of a helical gear that engages small-diameter gear 70*c* is formed on the outer peripheral surface of cable drum 68.

In power unit 14 of vehicle door latch apparatus 10 that is used for a normal hinge-type vehicle door, an output of about 615N (newton) is required as a force to pull cable 58 at the outer end thereof (at the end portion on the side of latch unit 12, or at the end that is coupled to operation unit 13) at an ambient temperature of 23° C. and a at a supply voltage of 12V. The corresponding output of power unit 14 is about 315.5 to 1144N at an ambient temperature of −40 to 80° C. and at a supply voltage of 9 to 16V. The output of motor 67 of power unit 1 can be about 210N under the same conditions when using deceleration mechanism 69 having the worm gear and the helical gear.

There is no movable member arranged in rear space 64*b* of main body 64. In the embodiment, a circuit board (not illustrated) that is connected to electric cables 73 is arranged in rear space 64*b*. Electric cables 73 include a power line to motor 67 and a signal line of drum sensor 74 that detects the rotational position of cable drum 68. Drum sensor 74 functions by coming into contact with cam protrusion 68*b* of cable drum 68 and detects the initial position of cable drum 68 (the position at which the cable is fed).

When latch 16 is in the half-latched position, motor 67 rotates cable drum 68 in order to pull and take up cable 58. When latch 16 comes to the full-latched position, motor 67 is reversed and rotates cable drum 68 in the reverse direction in order to feed cable 58. When cable drum 68 returns to the initial position, cam protrusion 68*b* comes into contact with drum sensor 74. Motor 67 stops and power unit 14 returns to the initial state.

Since rear space 64*b* where no movable member is provided is covered with back cover 66, the operational performance that reduces and insulates the operational noise of the movable members, which are provided in drive system housing chamber 64*a* on the back side of rear space 64*b*, is improved.

Figure 21:
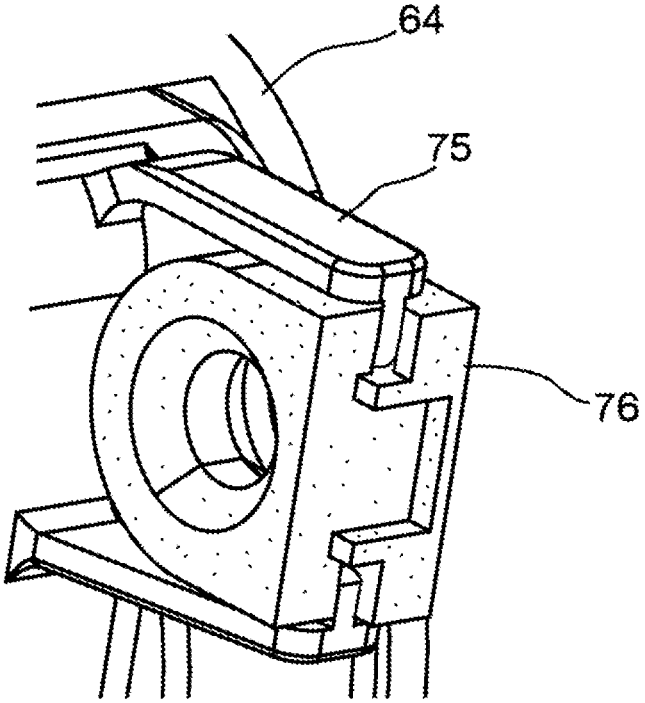
FIG. 21 is a perspective view of a connecting element of the main body and a vibration damping rubber.

A plurality of connecting elements 75 is provided on the outer periphery of main body 64 of power unit 14, and each connecting element 75 is fixed to the end portion of each attachment plate 61 via vibration damping rubber 76 (FIG. 21). Thus, the vibration of power unit 14 can be effectively absorbed.

Figure 22:
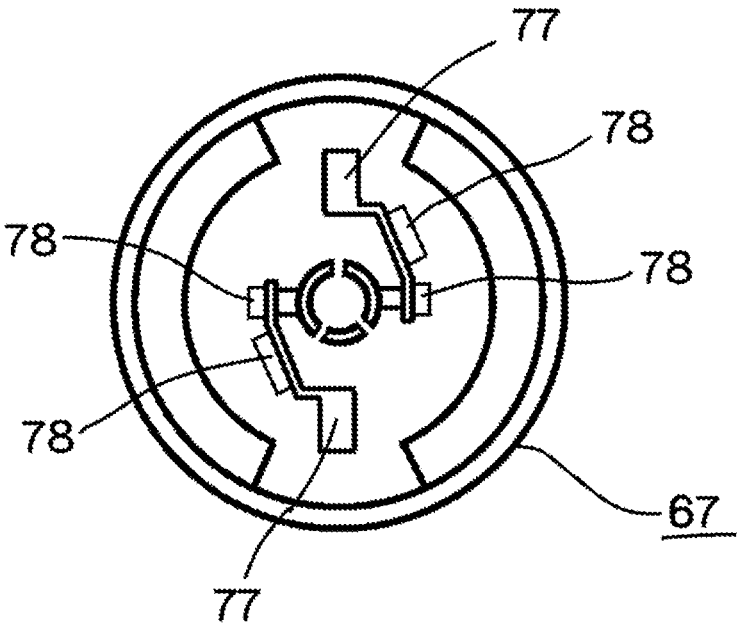
FIG. 22 is a schematic diagram showing the internal structure of a motor of the power unit.
Figure 23:
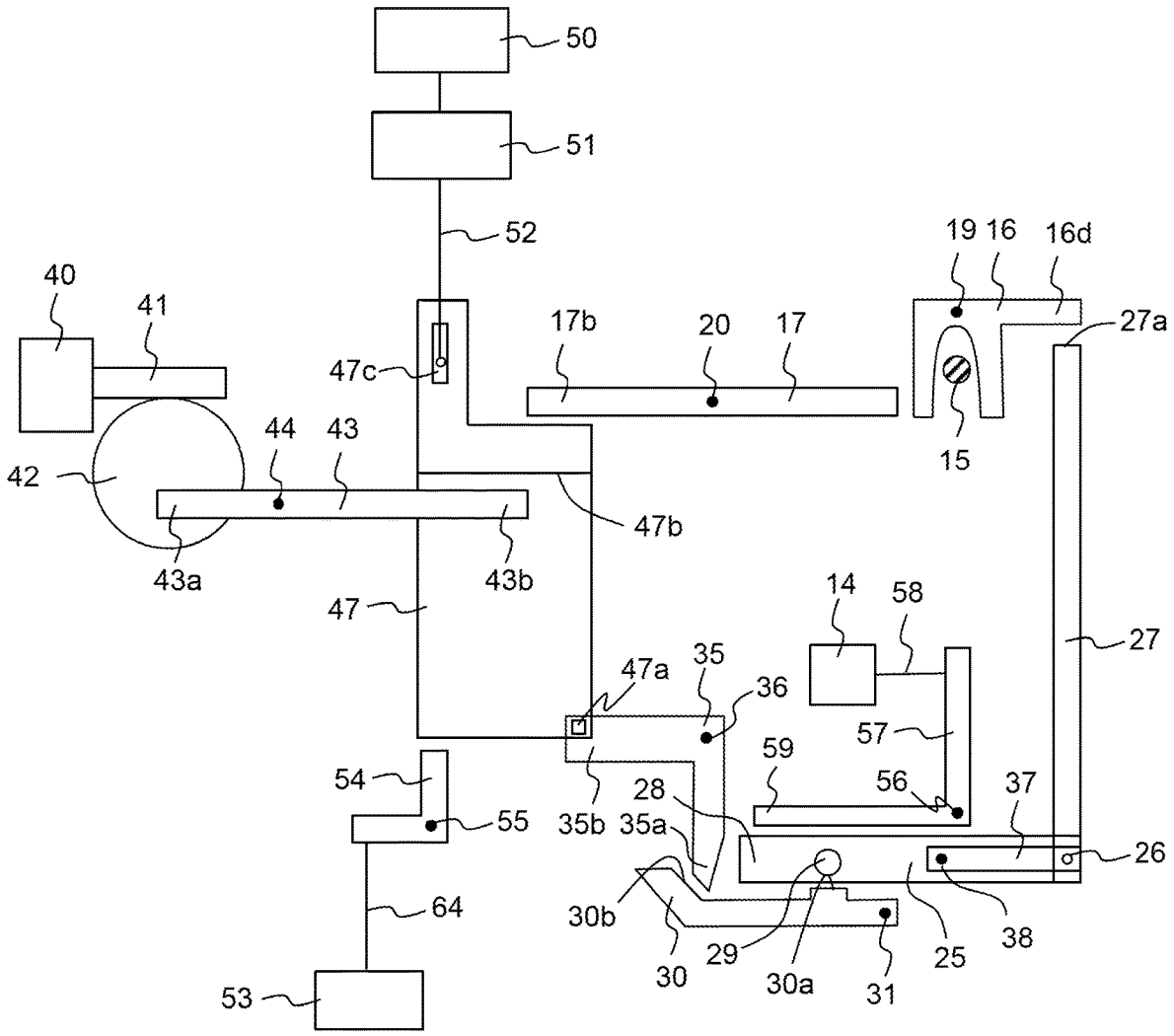
FIG. 23 is a conceptual view showing the connection of various elements of the vehicle door latch apparatus, wherein the black circles in the figure show fixed rotational axes.

Motor 67 of power unit 14 is a DC brush motor. As shown in the schematic diagram of FIG. 22, vibration damper 78 is attached to both of brush arms 77. Vibration damper 78 is provided on a bent portion of each of brush arms 77. As illustrated, two vibration dampers 78 are preferably provided for each of brush arms 77, thereby the operational noise of motor 67 can be reduced.

As described above, power unit 14 according to the present invention is provided with a large number of sound-proofing, vibration-proofing and vibration-damping measures, thereby achieving satisfactory reduction of operational noise, as compared to a conventional product with the same level output. As an example, power unit 14 was attached to an immobile member (equivalent to inside door panel 11), in which no element corresponding to sound-proofing and sound-absorbing cover 62 was provided, and the operational noise of power unit 14 was measured independently. A microphone for measurement (LA-5111 produced by Ono Sokki Co., Ltd.) was installed 300 mm right above power unit 14.

The operational noise of power unit 14 according to the example at an ambient temperature of 23° C. ranged between 42.2 to 40.9 dB at a voltage of 9V, 47.5 to 43.9 dB at a voltage of 12V, and 49.7 to 46.5 dB at a voltage of 16V.

Although several preferred embodiments of the present invention have been shown and described in detail, it should be understood that various changes and modifications can be made without departing from the spirit or scope of the appended claims.

The invention claimed is:

1. A vehicle door latch apparatus comprising:

a latch unit that is attached to an end portion of a vehicle door, the latch unit including:

a latch that has a half-latching step that defines a half-latched position of the latch, as well as a full-latching step that defines a full-latched position of the latch, and that is rotated from an unlatched position toward the full-latched position when the latch engages a striker, a ratchet that prevents the latch from rotating in an unlatching direction when the ratchet engages the half-latching step and the full-latching step, and a first cinching lever that is rotated to displace the latch from the half-latched position to the full-latched position, a cable that rotates the first cinching lever; and a power unit that is attached to the vehicle door and that is separated from the latch unit, the power unit including a motor, a cable drum onto which one end of the cable is wound and that takes up and feeds the cable, a deceleration mechanism that transfers power of the motor to the cable drum, and a closed housing that houses the motor, the cable drum, and the deceleration mechanism, wherein operation noise at 300 mm right above the housing of the power unit is 42.2 to 40.9 dB at a supply voltage to the motor of 9V, 47.5 to 43.9 dB at a supply voltage of 12V, and 49.7 to 46.5 dB at a supply voltage of 16V, the deceleration mechanism includes a large-diameter gear and a small-diameter gear that are integrally formed and that are coaxial with each other, the motor has a cylindrical worm formed on an output shaft thereof, and the cable drum has a drum gear on an outer peripheral surface thereof, and the large-diameter gear is a worm wheel gear that engages the cylindrical worm, and the small-diameter gear is a helical gear that engages the drum gear.

2. The vehicle door latch apparatus according to claim 1, wherein the motor includes a brush arm, and a vibration damper is attached to the brush arm.

3. The vehicle door latch apparatus according to claim 1, further comprising a connecting element that connects the housing to an inside door panel of the vehicle door, and a vibration damping rubber that is arranged between the housing and the connecting element.

4. The vehicle door latch apparatus according to claim 1, wherein the housing includes:

a main body that defines both a drive system housing chamber on an inner side thereof and a back space on an outer side thereof, wherein the drive system housing chamber houses the motor, the cable drum, and the deceleration mechanism;

a front cover that covers the drive system housing chamber; and a back cover that covers the back space.

5. The vehicle door latch apparatus according to claim 1, wherein a force of the power unit to pull the cable at an end portion thereof on a side of the latch unit is 315.5 to 1144N at an ambient temperature of −40 to 80° C. and at a supply voltage of 9 to 16V to the motor.

* * * * *